US006374418B1

(12) United States Patent
Rindle

(10) Patent No.: US 6,374,418 B1
(45) Date of Patent: Apr. 23, 2002

(54) ADJUSTABLE HOOD SYSTEM

(75) Inventor: Markus M. H. Rindle, Boulder, CO (US)

(73) Assignee: Salomon, S.A. (FR)

( * ) Notice: Subject to any disclaimer, the term of this patent is extended or adjusted under 35 U.S.C. 154(b) by 0 days.

(21) Appl. No.: 09/709,666

(22) Filed: Nov. 9, 2000

(51) Int. Cl.[7] ..... A42B 1/04
(52) U.S. Cl. ..... 2/202; 2/84
(58) Field of Search ..... 2/202–204, 84, 2/69

(56) References Cited

U.S. PATENT DOCUMENTS

| | | | | |
|---|---|---|---|---|
| 2,560,598 A | | 7/1951 | Rinis | |
| 2,567,192 A | | 9/1951 | DeGrazia | |
| 2,679,647 A | | 6/1954 | Gossner | |
| 5,369,809 A | | 12/1994 | Hall | |
| 5,832,538 A | * | 11/1998 | Williams | 2/202 |
| 5,960,478 A | * | 10/1999 | Sivret et al. | 2/202 |
| 6,088,838 A | * | 7/2000 | Sontag | 2/202 |

FOREIGN PATENT DOCUMENTS

| | | |
|---|---|---|
| EP | 0 673 609 A1 | 9/1995 |
| EP | 0 808 582 A1 | 11/1997 |
| JP | 8-232109 | 10/1996 |
| JP | 11-61544 | 5/1999 |

* cited by examiner

*Primary Examiner*—John J. Calvert
*Assistant Examiner*—Katherine Moran
(74) *Attorney, Agent, or Firm*—Patton Boggs LLP

(57) ABSTRACT

An adjustable hood system for simultaneously adjusting the shape of the hood on wearer's head in directions having longitudinal, lateral and vertical components with a single drawstring. Each side has a front passageway that extends from the temple area, along the face opening, and then curves backward. Each side also has a back passageway that extends backward from the top of the hood and then curves downward and then curves forward. The front passageway and the back passageway each have openings adjacent to each other in the lower region. On each side, one end of a drawstring is attached to the upper end of the front passageway, the other end is attached to the top end of the back passageway, and a portion of the drawstring is exposed between the openings in the lower region where it may be manipulated by the wearer for adjustment of the hood. Preferably, a cinch clamp is disposed on the exposed section of the drawstring to maintain an adjustment.

27 Claims, 8 Drawing Sheets

ADJUSTABLE HOOD SYSTEM

BACKGROUND OF THE INVENTION

1. Field of the Invention

The invention relates to a hood system providing convenient adjustment, good protection, comfort and flexibility of movement.

2. Statement of the Problem

Hoods for outerwear garments typically have a face opening and a drawstring provided in the passageway around the periphery of the face opening. The ends of the drawstring extend out of the passageway and are used to adjust the size of the face opening. When the ends of the drawstring are pulled and tightened, the face opening of the hood is made smaller, and no other adjustment of the hood, not in the lateral or in the vertical or in the longitudinal direction, is available to accommodate the wearer's head size or movement.

U.S. Pat. No. 2,679,647 issued Jun. 1, 1954 to Gossner discloses a hood having an external buckle and strap arrangement for providing vertical adjustment of the hood to adjust the forward edge of the hood with respect to the face of the wearer.

U.S. Pat. No. 2,567,192 issued September 1951 to DeGrazia discloses a hood adjustment having an oversized head covering portion with an inverted "V"-shaped channel at the rear of the hood that contains a drawstring secured at each end of the inverted "V". The free end of each drawstring is pulled separately or in conjunction with the second drawstring so that the anchored ends are drawn toward each other and then pull the central portion of the hood down toward the base of the neck.

U.S. Pat. No. 2,560,598 issued Jul. 17, 1951 to Rinis discloses a crisscrossing shoelace-type lacing arrangement at the rear neck area of a parka hood on opposing external flaps. This lacing arrangement provides primarily lateral adjustment of the hood in the base of the neck area.

U.S. Pat. No. 5,369,809 issued Dec. 6, 1994 to Hall, depicted in FIG. 1, discloses a hood system having a pair of elasticized drawstrings 16 fixed at the two temple areas 18 of the wearer and extending through passageways 14 along the sides of the crown area 19 to the area corresponding to the nape of the neck 20, where they exit at the lower rear portion of the hood 10. Operation of the drawstrings is intended to provide vertical and lateral adjustability around the head of the wearer. This subsystem has several disadvantages. Adjustment of the hood is inconvenient because manipulation of the pair of drawstrings must be performed at the back of the head. As the drawstrings are tightened, the back panel of the hood is drawn together; in addition, the vertical length of the back panel and the longitudinal length of the top are shortened. As a result, the wearer is restricted in movement. Both bending of the head at the neck (flexion) and twisting of the head by rotation at the neck (torsion) become limited as a result of tightening. Furthermore, for the hood to be used practically, a second drawstring system around the periphery of the face opening must be provided and operated.

European Patent Application by Aumann, Publication No. 0673609A1, describes a hood in which the volume is adjusted by a drawstring located at the center of the top and by drawstrings on each side of the hood. The top drawstring adjusts the lateral width of the top of the hood. The side drawstrings are positioned horizontally or diagonally to adjust the size of the side panels. Adjusting the shape and volume of the hood, therefore, requires manipulation of three or more drawstrings. Reducing the top panel of the hood causes a pinching together of the hood at the forehead of the wearer and results in distortion of a hood visor, if present. Adjustment of the sides of the hood is unidirectional, resulting in unbalanced adjustment of the shape and volume of the hood. As a result, a good fit may be difficult to achieve, and flexion and torsion of the wearer is inhibited.

A conventional hood 50 is depicted in FIGS. 2 and 3. It is characterized by a drawstring 52 disposed around the periphery 54 of face opening 56 and in a passageway 58 around the neck of the wearer at a position corresponding to a collar. As the part of the drawstring around the face opening is tightened, the peripheral vision of the wearer is reduced. As part of the drawstring in passageway 58 is tightened, flexion and torsion of the head is restricted. Furthermore, adjustment of the drawstrings does not adjust the volume or shape of the hood, it merely adjusts the tightness of the drawstring seams about the head of the wearer.

SUMMARY OF THE INVENTION

The invention provides a simple, effective hood system, especially useful for outerwear, for example, for athletic jackets and winter coats.

A hood system in accordance with the invention comprises a hood and a drawstring arrangement. The hood includes flexible material and has a back, a top, and two sides, with a volume and a shape for covering the back area, the top area and the side areas of a wearers head. The hood further has a face opening for exposing the wearers face, wherein the top has a top forward edge, each side has a side forward edge, and the top forward edge and the two side forward edges partly define the face opening.

The drawstring arrangement simultaneously adjusts the shape and volume of the hood on the wearer's head in directions having longitudinal, lateral and vertical components. The drawstring arrangement includes a front drawstring passageway in each side of the hood extending from the temple region and extending downwards along the edge of the face opening and then curving backwards in the lower region, where it has a first drawstring opening. The drawstring arrangement also includes a back passageway in each side of the hood, having one end at the top and extending backwards and curving downwards in the rear region and then curving forward in the lower region towards the first drawstring opening. The back passageway has a second drawstring opening near the first drawstring opening. The drawstring arrangement has a drawstring disposed in the front passageway and the back passageway in each side of the hood. Each drawstring has a first fixed end attached to the upper end of the front passageway, and a second fixed end attached to the top end of the back passageway. Also, each drawstring has an exposed section between the first drawstring opening and the second drawstring opening in the lower region of each side of the hood. The exposed section is easily accessible for manipulation to adjust the volume and the shape of the hood. Because the drawstring extends in all directions around the side of the head, adjustment of each drawstring results in a balanced compression of the flexible material in each side panel. Thus, the shape and volume of the hood is adjusted in a balanced manner, resulting in good protection of the head against outside elements and a comfortable fit. In contrast with hoods in the prior art, the back of a hood in accordance with the invention is not compressed when the drawstrings are tightened. As a result, flexion (bending of the head at the neck) and torsion (twisting of the head by rotation at the neck) movement of the head wearing a hood is not restricted. The top of the hood also is not compressed. As a result, the width of the face opening is not significantly affected, and the peripheral vision of the wearer is not reduced. The good fit and mobility achieved by a hood system in accordance with the invention may be enhanced if the drawstring is an elastic cord, and also when the passageways, especially the front passageways, comprise stretch material.

Numerous other features and advantages of a hood system in accordance with the invention will become apparent in the description below.

DETAILED DESCRIPTION OF THE INVENTION

The invention is described below with the aid of FIGS. 4–10. It should be understood that FIGS. 4–10 represent only an exemplary embodiment of a hood system according to the invention. A hood system in accordance with the invention may be embodied in many variations that do not depart essentially from the embodiments described herein. It should be further understood that FIGS. 4–10 are only schematic depictions of hood systems in accordance with the invention, and these figures do not limit the scope of the invention, which is defined by the claims below.

Terms of direction in this specification are used in a manner consistent with their plain meaning, which should be obvious from the context in which they are used with reference to the drawings. The terms "vertical" and "horizontal" designate planes of orientation with respect to an upright hood as depicted in FIGS. 4, 5, 9, 10 and 11. The term "longitudinal" refers to a direction parallel to a line between the front and back of a wearer's head. The term "lateral" refers to a direction substantially parallel to the plane of a wearer's forehead. Similarly, terms of orientation, such as top, upper, bottom, lower, back, side, front, forward and others, have a plain meaning with reference to the figures.

Figure 4:
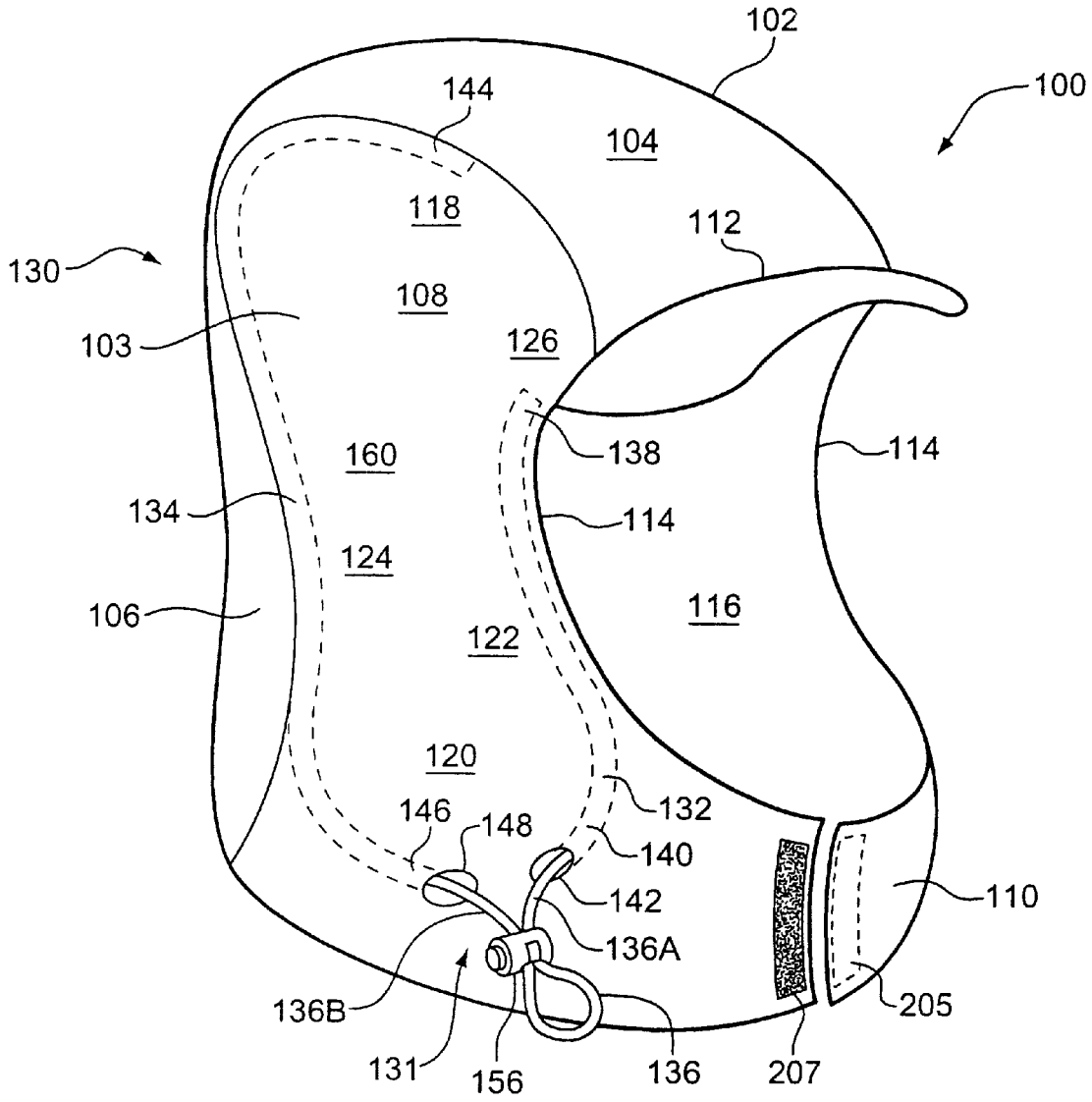
FIG. 4 is a perspective view of a hood system in accordance with the invention.

FIG. 4 is a perspective view of a hood system 100 in accordance with the invention. Hood system 100 comprises hood 102 having a top 104, a back 106, and two sides 108, of which the right side is shown in FIG. 4. Top 104, back 106 and sides 108 correspond to the top area, the back area and the side areas of a wearer's head. Each side 108 of hood 102 includes an ear region 160, a top region 118 generally above the ear region 160, a lower region 120 generally below the ear region 160, a forward region generally forward of ear region 160, and a rear region 124 generally back of ear region 160. Hood 102 comprises flexible panel-like material 103 so that the shape of the hood and volume enclosed by it may be adjusted in accordance with the invention to provide the wearer of the hood good protection from the outside, while maintaining comfort and flexibility. In particular, it is important that back 106 and sides 108 are flexible. Top 104 may also be flexible, but it may also be more or less rigid in some embodiments. A hood 102 in accordance with the invention typically has a chin portion 110 that covers the chin area of the wearer's head or is disposed directly under the chin area. Top 104 has a top forward edge 112, and each of sides 108 has a side forward edge 114. Top forward edge 112, side forward edges 114 and chin portion 110 define a face opening 116 for exposing the wearer's face. Upper region 118 preferably extends in the longitudinal direction and borders top 104. Lower region 120 preferably extends in substantially the longitudinal direction. Forward region 122 preferably extends substantially in the vertical direction and borders side forward edge 114. Rear region 124 preferably extends substantially in a vertical direction and borders back 106. Finally, each side 108 has a temple region 126 located at the intersection of upper region 118 and forward region 122. In an embodiment as depicted in FIG. 4, hood 102 includes a visor 113 attached to forward edge 112.

Hood system 100 further comprises a drawstring arrangement 130 for simultaneously adjusting the shape of the hood on the wearer's head in directions having longitudinal, lateral and vertical components, and thereby also adjusting the volume enclosed by the hood and the tightness of the hood. Drawstring arrangement 130 includes: a drawstring passageway 131 on each side 108 of the hood, the drawstring passageway including a front passageway portion 132 on each side 108 of hood 102, a back passageway portion 134 on each side 108, and a drawstring 136 on each side 108. Drawstring 136 preferably includes a front drawstring portion 136A and a back drawstring portion 136B. Front passageway 132 has an upper end 138 and a lower end 140. Upper end 138 is located near forward edge 114 in temple region 126. Lower end 140 is located in lower region 120 and has a first drawstring opening 142. Front passageway 132 extends from upper end 138 along forward edge 114 and then curves backwards from the forward edge in lower front region 120. Back passageway 134 has a top end 144 located in upper region 118 and a bottom end 146 located in the lower region 120. Back passageway 134 extends backwards from top end 144 along top 104, on which it borders, and then curves downwards in rear region 124 along and bordering back 106, and then curves forward in lower region 124 towards first drawstring opening 142. Back passageway 134 has second drawstring opening 148 at its bottom end 146 proximate first drawstring opening 142. Drawstring 136 is disposed in front passageway 132 and back passageway 134 in each side 108 of hood 102.

Figure 1:
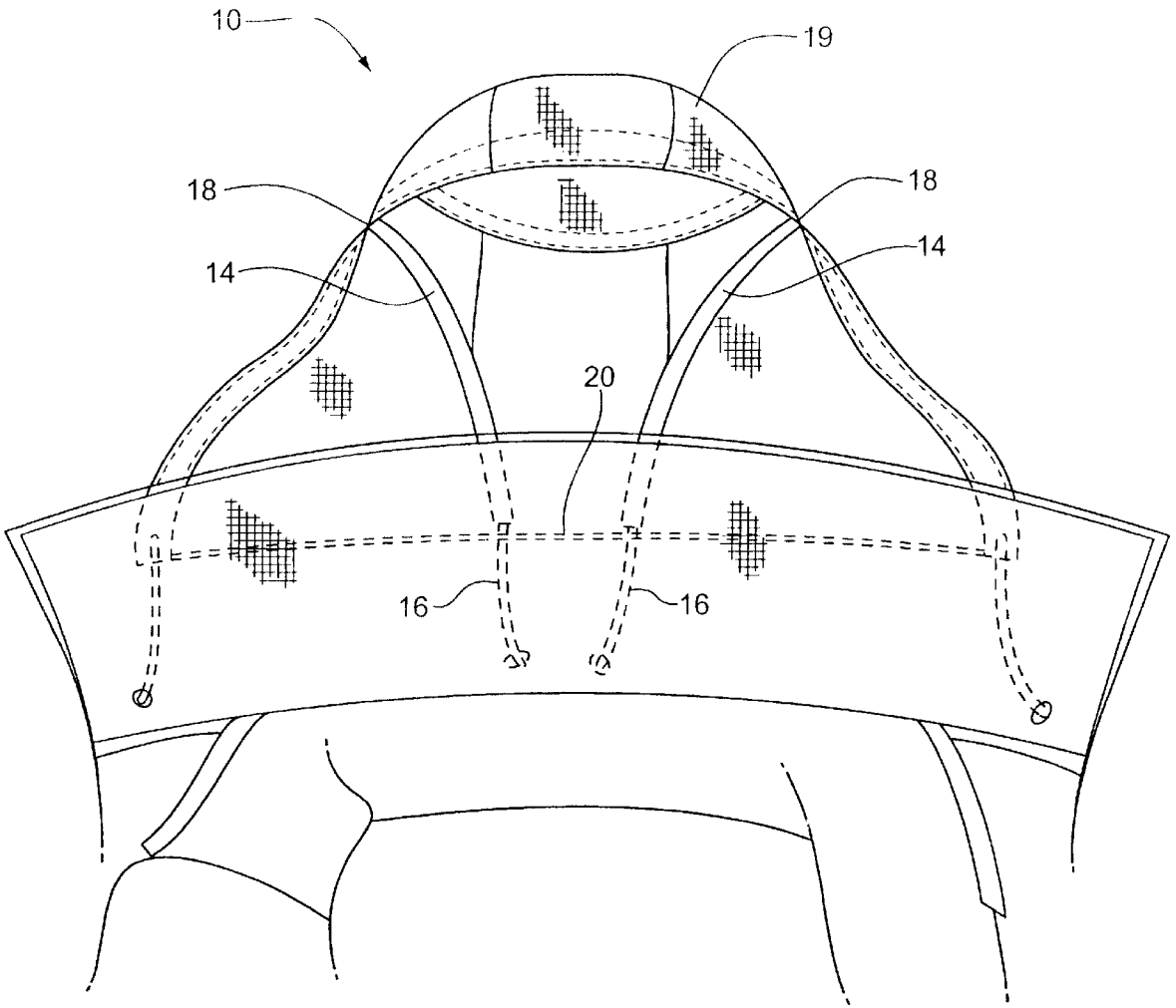
FIG. 1 PRIOR ART
FIG. 1 depicts a hood of the prior art having three drawstrings that restricts mobility of the wearer's head.
Figure 3:
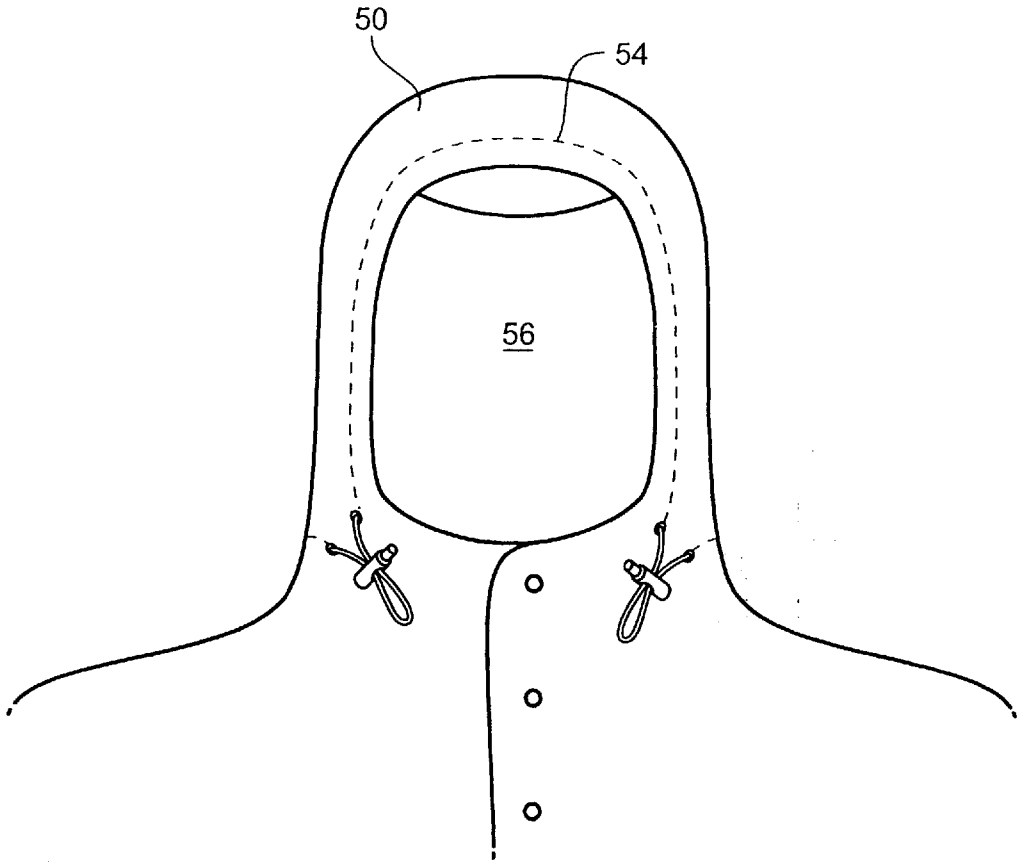
FIG. 3 PRIOR ART
FIGS. 2 and 3 depict a hood of the prior art having two drawstrings that restricts mobility of the wearer's head.
Figure 2:
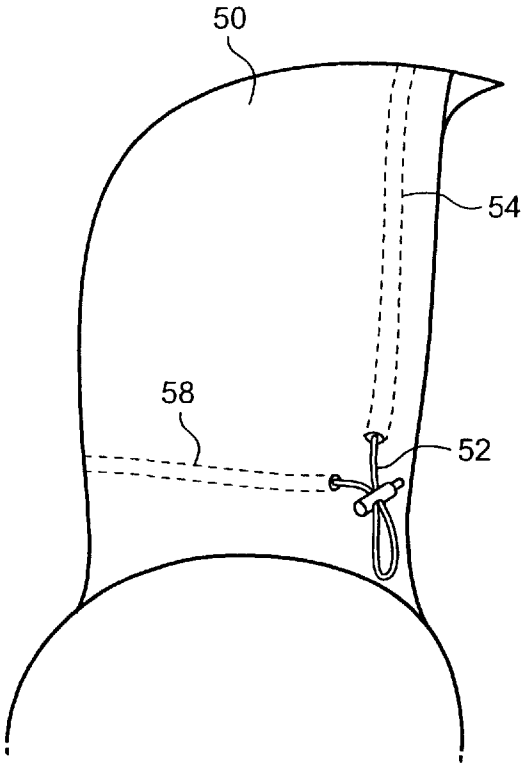
FIG. 2 PRIOR ART
Figure 5:
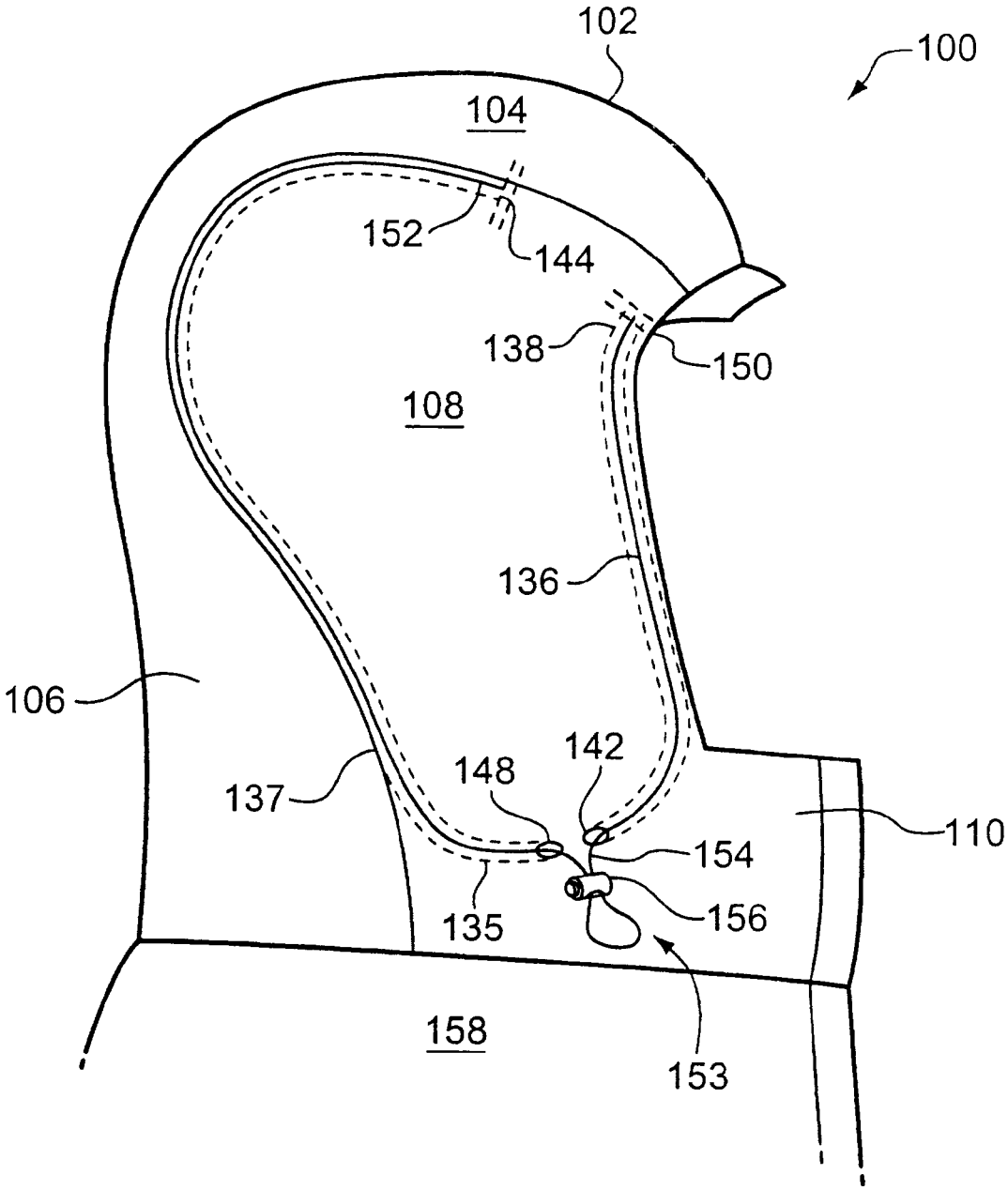
FIG. 5 is a side view of the hood system depicted in FIG. 4.

As can be seen best in FIGS. 4 and 5, drawstring passageway 131 roughly encircles ear region 160. Preferably, passageway 131 at least 50% encircles ear region 160, which means that it covers a total arc about ear region 160 of at least 180 degrees. Most preferably, passageway 131 two-thirds or 66.67% encircles ear region 160. By encircling the ear region 160, when the drawstring 136 is pulled, the drawstring arrangement 130 gathers in the flexible material 103 and decreases the volume of the hood. This shapes the hood to the wearer's head much more effectively than prior art systems such as shown in FIGS. 2 and 3 which merely adjust the hood openings, leaving the hood ill-fitting. In addition, material 103 is gathered separately on each side of the hood; that is, one drawstring 136 gathers material only on the right side 108 of the hood, while the other drawstring gathers material only on the left side 109 (FIG. 9) of the hood. This allows each side of the hood to be independently adjusted, making for a much more comfortable fit.

FIG. 5 is a schematical side view of hood system 100. As depicted in FIG. 5, drawstring 136 has a first fixed end 150 attached to upper end 138 in front passageway 132, and a second fixed end 152 attached to top end 144 of back passageway 134. Drawstring 136 has a manipulation element 153 comprising an exposed section 154 located between first drawstring opening 142 and second drawstring opening 148 and a lock 156. The shape of hood 102 and the volume enclosed by the hood is adjustable by means of manipulating exposed section 154 of the drawstring. Drawstring arrangement 130 of hood system 100 typically comprises a drawstring lock 156 on each side 108 of hood 102 to maintain an adjustment of each drawstring 136. Typically, drawstring lock 156 is a cinch clamp. Typically, hood 102 is attached to a collar 158 of an outer garment. Top 104 and back 106 of hood 102 of FIGS. 4 and 5 are preferably made from a single panel of flexible material. In other embodiments of a hood system in accordance with the invention, top 104 and back 106 may each be separate panels.

Figure 6:
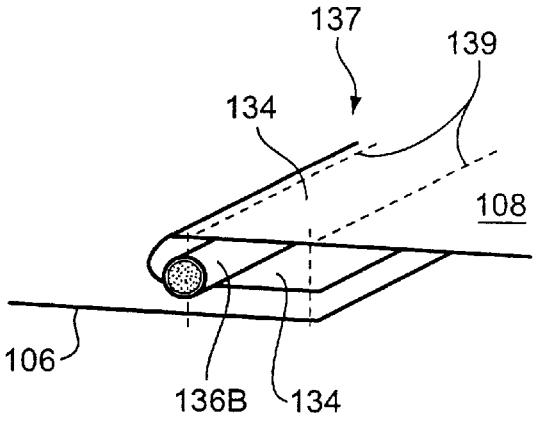
FIG. 6 depicts a structure of a back passageway containing a drawstring in accordance with the invention.

Drawstring 136 may be elastic or nonelastic. Preferably, drawstring 136 is an elastic cord. Front passageway 132 and back passageway 134 may be formed in hood 102 using various techniques and materials. For example, as depicted in FIG. 6, back passageway 134 may be fabricated by forming an allowance in the seam 137 joining a side 108 and back 106. In FIG. 6, the panel-like material of side 108 is folded back in the region of the seam 137 so that a tunnel enveloping drawstring 136B is formed on side 108 and is attached to back 106, typically by stitching 139.

Figure 7:
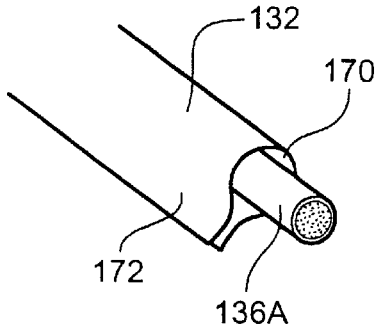
FIG. 7 depicts a structure of a front passageway containing a drawstring in accordance with the invention.
Figure 8:
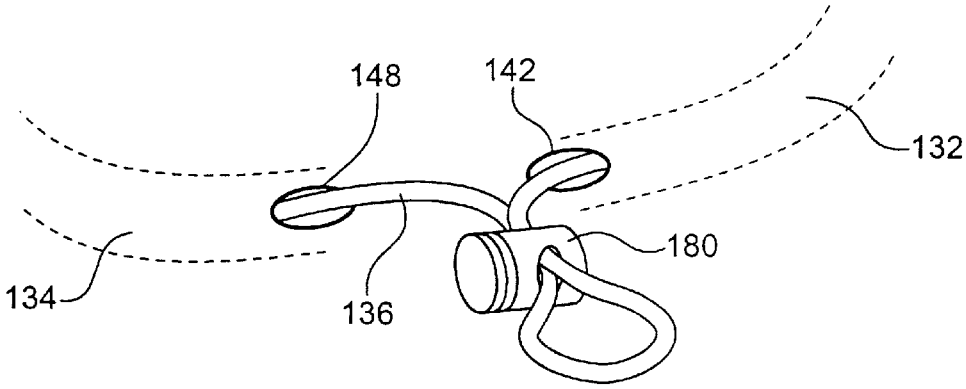
FIG. 8 depicts the exposed section of a drawstring held by a cinch clamp between outlet openings of a drawstring arrangement in accordance with the invention.

Adhesive may also be used alone or in combination with the stitching 139. For the portion 135 of back passageway 134 in the lower region 120 that curves away from seam 137 towards second drawstring opening 148, fabric is added to create the rest of back passageway 134. An example of a tunnel structure for portion 135 and for front passageway 132 is depicted in FIG. 7. A tunnel 170 in which drawstring 136 is disposed may be formed simply by folding an elongated piece of panel-like material 172. Material 172 is attached by sewing and/or adhesive, preferably by sewing, to the inside surface of side 108 to form front passageway 132 or portion 135. If hood 102 comprises two layers of material, then drawstring passageways 132 and 134 may be assembled between layers. In some embodiments of a hood system in accordance with the invention, drawstring passageways 132 and 134 may be assembled on the outside surface of sides 108. Preferably, front passageway 132 comprises stretch or elastic material, which contributes to a tighter fit of the edges of the hood around the face of the wearer. Back passageway 134 may also be constructed using stretch or elastic material. Preferably, drawstring 136 is elastic. Preferably, drawstring lock 156 of FIG. 5 is a cinch clamp 180, as depicted in FIG. 8.

Figure 9:
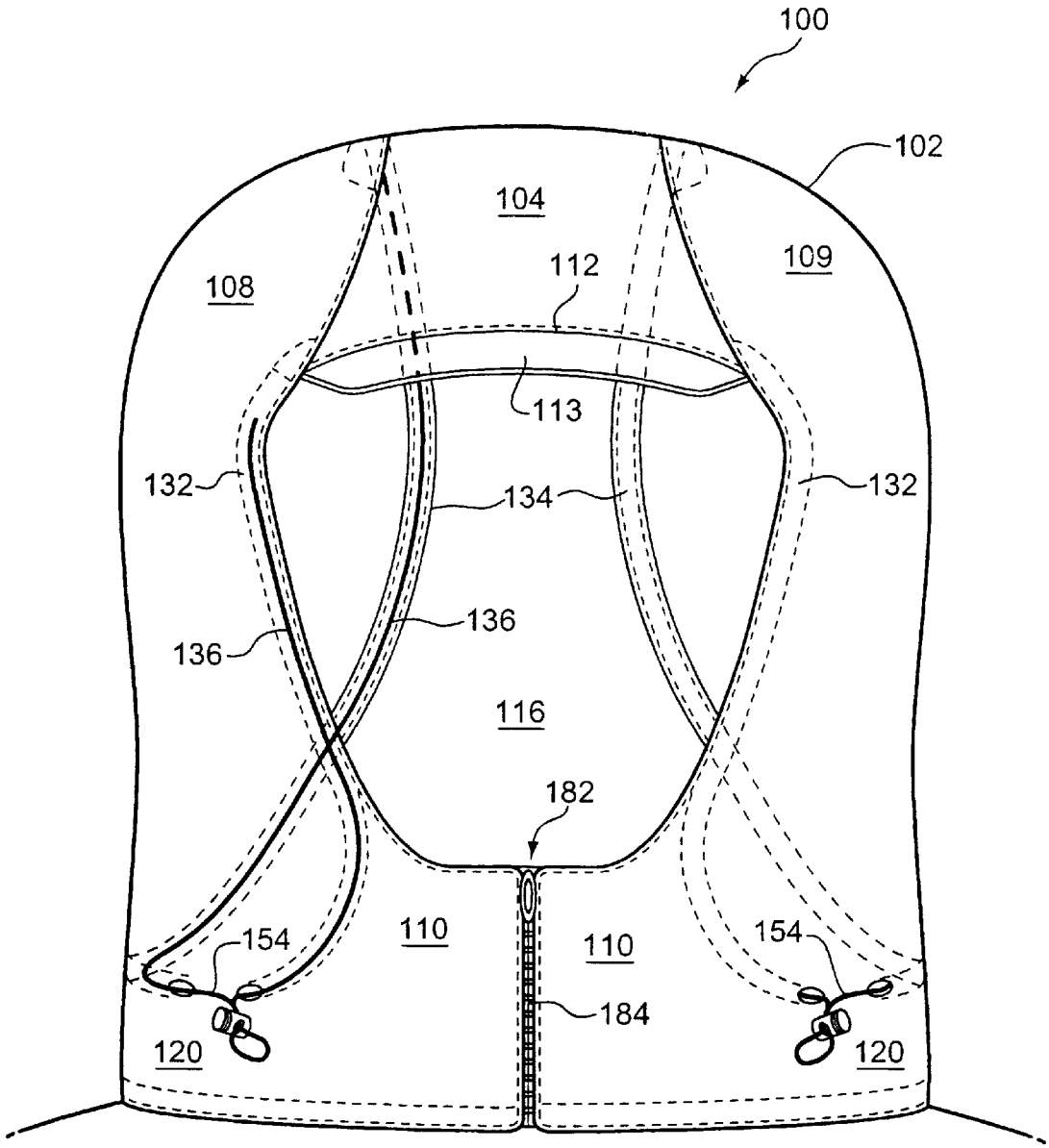
FIG. 9 is a front view of the hood system depicted in FIGS. 4 and 5.

FIG. 9 is a front view of hood system 100. Chin portion 110 defines the bottom edge of face opening 116. In the embodiment of hood system 100, depicted in FIGS. 4, 5 and 9, chin portion 110 has a longitudinal opening 182 that is typically closed when a hood is being used by the wearer. FIG. 9 shows slide fastener 184 to close opening 182. Other types of fasteners may also be used for this purpose; for example, a hook-and-loop fastener. FIG. 9 shows the relative positions of front passageways 132 and back passageways 134 in hood 102. It is understood that FIG. 9 is a representation for purposes of illustration, and thus does not depict any particular hood 102 in accordance with the invention, and that the exact locations of the passageways may vary between embodiments.

Figure 10:
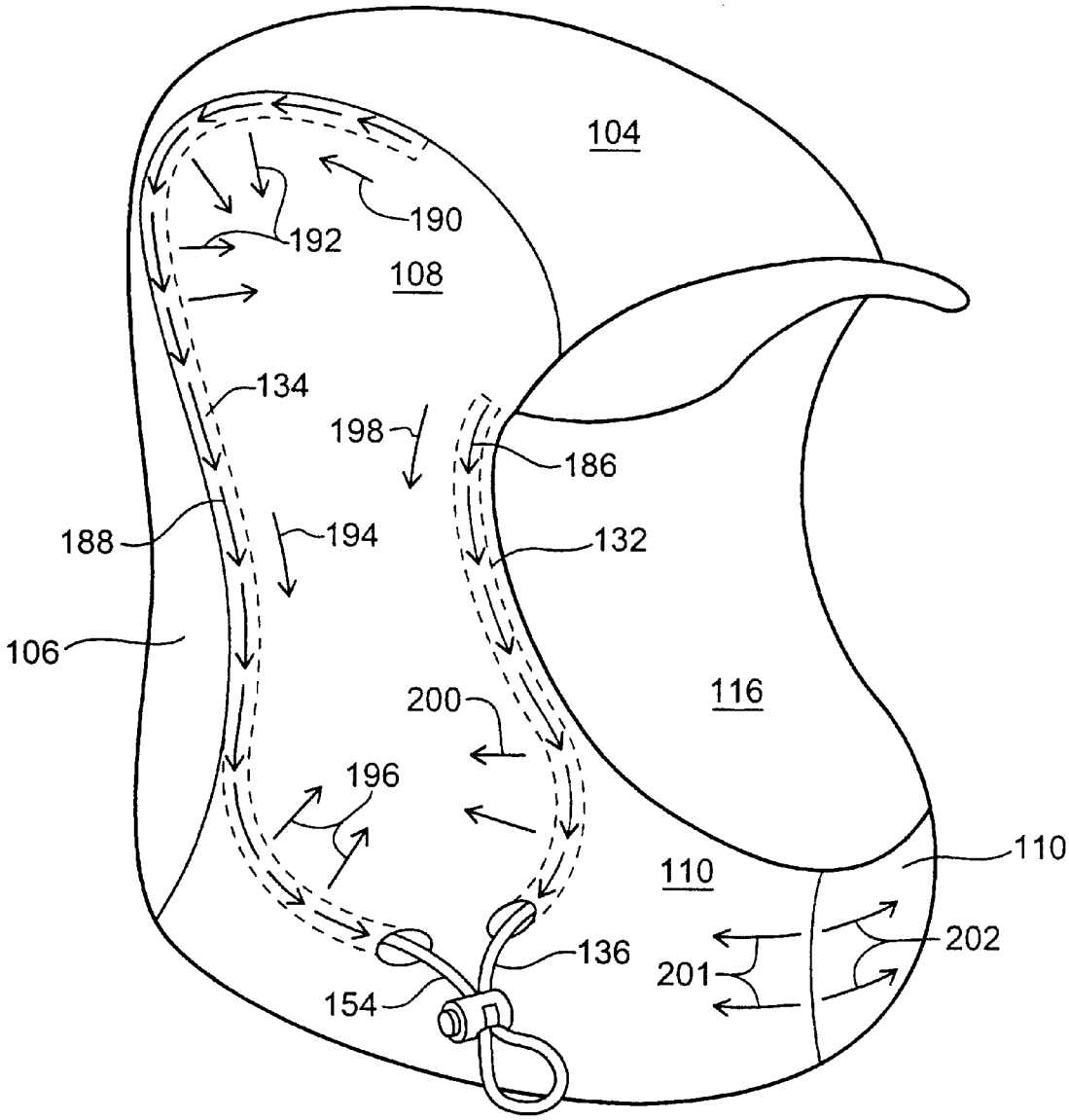
FIG. 10 is a perspective view of a hood system in accordance with the invention in which the arrows indicate directions of adjustment of the hood as drawstrings are tightened.
Figure 11:
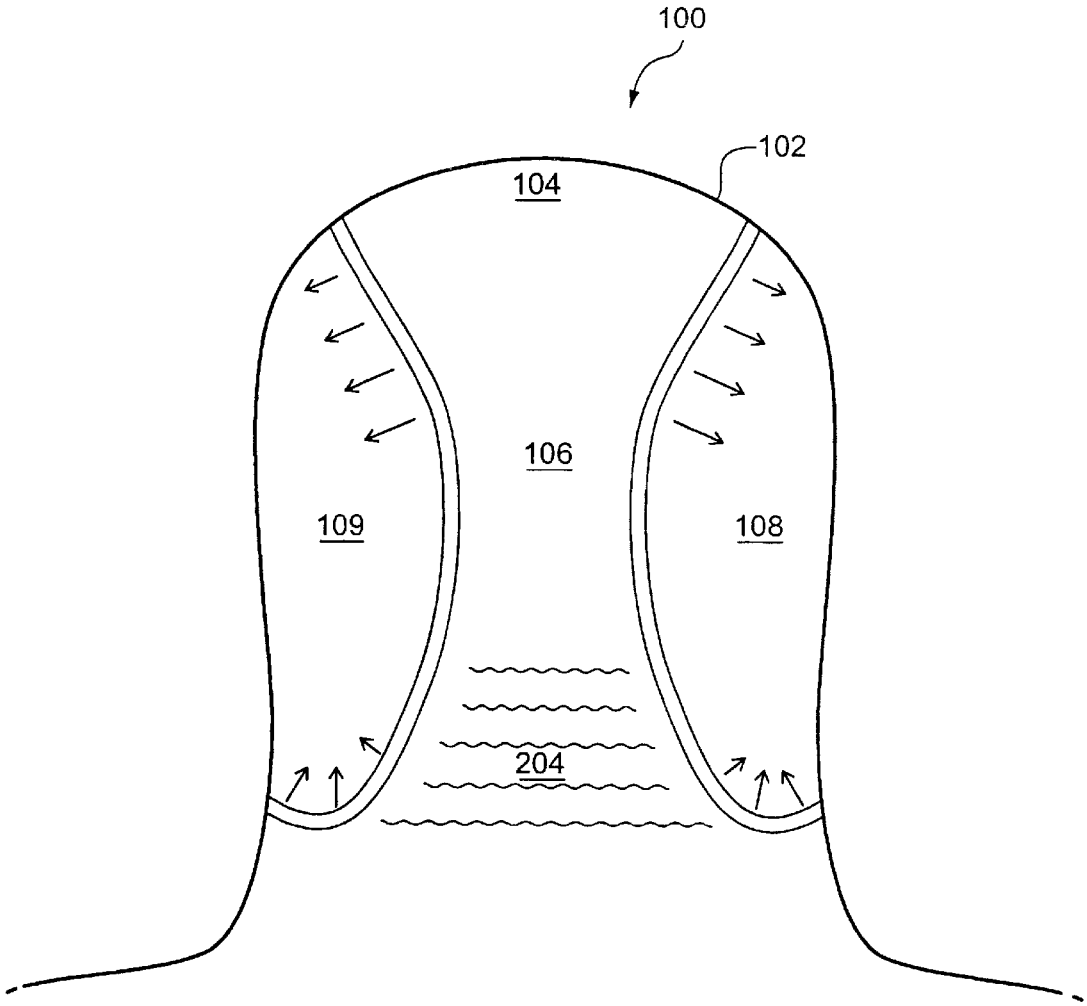
FIG. 11 is a rear view of a hood system in accordance with the invention showing "gathers" of material at the back of the neck as drawstrings are tightened, which maintains mobility of the head.

FIG. 10 indicates generally the movement of flexible material in hood 102, especially of sides 108, when drawstring 136 is tightened. As drawstring 136 is adjusted by pulling downwards on exposed portion 154, the drawstring is pulled in the direction of arrows 186 in passageway 132 and arrows 188 in passageway 134. The resulting tension caused in the flexible material of side 108 causes corresponding adjustment in the shape of and surface area of side 108. The flexible panel-like material of side 108 tends to move in the general directions indicated by arrows 190, 192, 194, 196, 198 and 200. The amount of movement in the different directions is influenced by numerous variables, including the original shape and size of the hood, the shape and size of the wearer's head, and the flexibility and elasticity characteristics of drawstring 136, passageways 132,134, and sides 108. As indicated in FIG. 10, a single manipulation of drawstring 136 on each side 108 of hood 102 results in balanced adjustment of the shape and volume of hood 102. As perhaps can best be seen in FIG. 9, adjustment of the drawstring in accordance with the invention results in forces being exerted in directions having longitudinal, lateral and vertical components. Compression in various regions of a side 108 caused by tightening of a drawstring 136 results in tension in other parts of the hood and corresponding adjustment of shape and volume. For example, in FIG. 10, compression indicated by arrows 200 causes tension in chin portion 110, indicated by arrows 201, 202. As a result, chin portion 110 is pulled tighter against the face of the wearer, improving the fit of the hood at the bottom periphery of the face opening. With the same tightening of drawstring 136, the tension in side 108 indicated by arrow 198 pulls top 104 closer to the forehead of the wearer, and the tension indicated by arrows 192 improves the fit of the hood at the top and back of the wearers head. In contrast, adjustment of a hood drawstring of the prior art usually results in a change in one dimension only. FIG. 10 and FIG. 11 show that the shape and volume of hood 102 are adjusted using a drawstring arrangement to effect changes in the size and shape principally of sides 108. In contrast, the size and surface area of top 104 and back 106 are less affected by an adjustment of drawstrings 136, and are not laterally compressed. Since forward edge 112 of top 104 is not laterally compressed, the width of the face opening is not significantly affected by tightening of the drawstrings, and the peripheral vision of the wearer is not reduced. Similarly, visor 113 attached to forward edge 112 is not deformed when drawstrings 136 are tightened. Also, when drawstrings 136 are tightened, "gathers" 204 of material form in back 106. Thus, even when hood 102 has been tightened about the head of the wearer, the gathers of material 204 preserve flexibility and mobility of the wearer's head; in particular, flexion and torsion are maintained. In contrast, in hoods of the prior art, a drawstring system typically decreases the physical dimensions of the hood around the neck, especially at the back of the wearer's head, reducing flexion and torsion. The balance referred to above is achieved automatically. For example, if chin portion 110 is already tight, while upper region 118 of side portion 108 is loose, then chin portion 110 will resist compression at arrows 200, and top portion 118 will not resist compression at 192; thus, the system will tend to gather in the looseness at region 118. In this manner, the system will tend to adjust looser regions first and not adjust regions where the hood already fits snugly.

There has been described a hood and hood system useful for protecting the head of a wearer, in particular, when used in conjunction with outerwear, for example, an athletic jacket or a winter coat. A hood system in accordance with the invention is useful because it provides a convenient adjustment of a hood to achieve a good, protective fit of the hood on the wearers head. At the same time, the hood system preserves flexion and torsion mobility of the wearer's head. It should be understood that the particular embodiments shown in the drawings and described within this specification are for purposes of example and should not be construed to limit the invention, which will be described in the claims below. Further, it is evident that those skilled in the art may now make numerous uses and modifications of the specific embodiments described, without departing from the inventive concepts. It is also evident that equivalent structures and compositions may be substituted for the various structures and compositions described. Consequently, the invention is to be construed as embracing each and every novel feature and novel combination of features present in and/or possessed by the embodiments described.

I claim:

1. An adjustable hood system, comprising:

a hood including flexible material, said hood having on each side of said hood: an ear region intended to cover a wearer's ear, a rear region generally back of said ear region, a forward region generally forward of said ear region, an upper region generally above said ear region, and a lower region generally below said ear region; said hood further having a face opening for exposing said wearer's face;

a drawstring arrangement for adjusting the shape of said hood on wearer's head, said drawstring arrangement including:

a front passageway in each side of the hood, the front passageway having an upper end located in said upper region and a lower end located in said lower region of said hood and having a first drawstring opening, said front passageway extending downwards in said forward region at or near said face opening and curving backwards in said lower region;

a back passageway in each side of the hood, the back passageway having a top end located in the upper region, said back passageway extending toward said rear region in said upper region and curving downwards in said rear region, and then curving forward in the lower region towards said first drawstring opening, said back passageway having a second drawstring opening proximate said first drawstring opening; and a drawstring disposed in the front passageway and the back passageway in each side of the hood, said drawstring having a first fixed end attached to said upper end, said drawstring having a second fixed end attached to said top end, said drawstring having an exposed section between said first drawstring opening and said second drawstring opening, said exposed section being accessible for manipulation, whereby said shape of said hood may be adjusted through manipulation of the drawstring in each side of said hood.

2. An adjustable hood system as in claim 1 wherein said drawstring comprises on each side of said hood a front drawstring portion disposed in said front passageway and a back drawstring portion disposed in said back passageway.

3. An adjustable hood system as in claim 1 wherein said drawstring arrangement is adapted for adjusting the shape of said hood on said wearer's head simultaneously in directions having longitudinal, lateral and vertical components.

4. An adjustable hood system as in claim 1 wherein said face opening has a top forward edge, and two side forward edges, said top forward edge and said two side forward edges partly defining said face opening, and said front passageway passing along said forward edge as it passes from said upper region to said lower region.

5. An adjustable hood system as in claim 1, further comprising an adjustable drawstring lock on each side of the hood to maintain an adjustment of the drawstring.

6. An adjustable hood system as in claim 1 wherein said hood has an exterior surface and an interior surface, and said front passageway and said back passageway are located on said interior surface.

7. An adjustable hood system as in claim 1, further comprising a visor located above said face opening and said drawstring arrangement is adapted for adjusting said hood without deforming said visor.

8. An adjustable hood system as in claim 1 wherein the top and back of the hood are made from a single panel of flexible material.

9. An adjustable hood system as in claim 1 wherein said drawstring is elastic.

10. An adjustable hood system as in claim 1 wherein the front passageway comprises stretch material.

11. An adjustable hood system as in claim 1 wherein the back passageway comprises stretch material.

12. An adjustable hood system as in claim 1, further comprising a chin portion having a closeable longitudinal opening.

13. An adjustable hood system as in claim 12, further comprising a fastener attached at said longitudinal opening, said fastener selected from the group consisting of a slide fastener and a hook-and-loop fastener.

14. An adjustable hood system, comprising:

a hood including flexible material and having a left side, and a right side, each of said left side and right side having an ear region intended to cover a wearer's ear; and on each of said left and right sides, a drawstring passageway at least 50% encircling said ear region.

15. An adjustable hood system as in claim 14 wherein said drawstring passageway comprises a front passageway portion and a back passageway portion which together at least 50% encircle said ear region.

16. An adjustable hood system as in claim 15 wherein said front passageway portion includes a first drawstring opening and said back passageway portion includes a second drawstring opening proximate said first drawstring opening.

17. An adjustable hood system, comprising:

a hood including flexible material and having a back, a top, a first side, and a second side;

a left drawstring arrangement including a left drawstring passageway having a left drawstring therein for gathering said flexible material only on the left side of said hood and thereby reducing the area and volume of said hood on said left side;

a right drawstring arrangement including a right drawstring passageway having a right drawstring therein for gathering said flexible material only on the right side of said hood and thereby reducing the area and volume of said hood on said right side.

18. An adjustable hood system as in claim 17 wherein either of said left drawstring arrangement or said right drawstring arrangement is adapted for adjusting the shape of said hood on said wearer's head simultaneously in directions having longitudinal, lateral and vertical components.

19. An adjustable hood system, comprising:

a hood including flexible material and having a back, a top, and two sides, said hood having a volume and a shape for covering the back area, the top area and the side areas of a wearer's head, said hood further having a face opening for exposing wearer's face, wherein the top has a top forward edge, each side has a side forward edge, and the top forward edge and the two side forward edges partly define the face opening, each side has an upper region extending in a longitudinal direction and bordering the top of the hood, a lower region extending in a longitudinal direction, a forward region extending in a vertical direction and bordering the side forward edge, and a rear region extending in a vertical direction and bordering the back of the hood, and a temple region located at the intersection of the upper region and forward region; and a drawstring arrangement for simultaneously adjusting the shape of the hood on wearer's head in directions having longitudinal, lateral and vertical components, said drawstring arrangement including:

a front passageway in each side of the hood, the front passageway having an upper end located near the forward edge in the temple region, and a lower end located in the lower region and having a first drawstring opening, the front passageway extending from said upper end along said forward edge and curving backwards from said forward edge in the lower region;

a back passageway in each side of the hood, the back passageway having a top end located in the upper region, said back passageway extending backwards from said top end in the upper region along the bordering top and curving downwards in the rear region along the bordering back and then curving forward in the lower region towards said first drawstring opening, said back passageway having a second drawstring opening proximate said first drawstring opening; and a drawstring disposed in the front passageway and the back passageway in each side of the hood, said drawstring having a first fixed end attached to said upper end, said drawstring having a second fixed end attached to said top end, said drawstring having an exposed section between said first drawstring opening and said second drawstring opening, said exposed section being accessible for manipulation, whereby the volume and the shape of the hood may be adjusted through manipulation of the drawstring in each side of the hood.

20. An adjustable hood system as in claim 19 wherein said drawstring comprises on each side of said hood a front drawstring portion disposed in said front passageway and a back drawstring portion disposed in said back passageway.

21. A method for adjusting a hood system, said method comprising:

providing a hood having a left side and a right side;

adjusting only the volume of either said left side or said right side of said hood without adjusting the volume of the other side of the hood.

22. A method for adjusting a hood system as in claim 21 wherein said step of adjusting comprises adjusting the shape of said hood on a wearer's head simultaneously in directions having longitudinal, lateral and vertical components.

23. A method for adjusting a hood system, said method comprising:

providing a hood including flexible material, said hood having on each side of said hood: an ear region intended to cover a wearer's ear, a rear region generally back of said ear region, a forward lower region generally forward of and below said ear region; and said hood also having a drawstring accessible for manipulation in said forward lower region; and causing said flexible material to gather in lateral folds in said rear region by manipulating said drawstring.

24. A method for adjusting a hood system, said method comprising:

providing a hood having a drawstring passageway, a drawstring in said drawstring passageway, and a single drawstring manipulation element accessible outside said passageway; and simultaneously adjusting the shape of said hood on said wearer's head in directions having longitudinal, lateral and vertical components utilizing only said single drawstring manipulation element.

25. A method for adjusting a hood system as in claim 24 wherein said step of adjusting comprises locking said drawstring to maintain said adjustment.

26. A method for adjusting a hood system as in claim 24 wherein said drawstring passageway comprises a front passageway portion and a back passageway portion; said drawstring includes a front drawstring portion in said front passageway portion and a back drawstring portion in said back passageway; and said step of providing comprises connecting said front drawstring portion to said back drawstring portion to form at least a portion of said drawstring manipulation element.

27. A method for adjusting a hood system, said method comprising:

providing a hood having a face opening for exposing the wearer's face and a visor located above said face opening; and simultaneously adjusting the shape of said hood on said wearer's head in directions having longitudinal, lateral and vertical components without deforming said visor.

* * * * *